United States Patent [19]

Varaney

[11] 4,173,048

[45] Nov. 6, 1979

[54] PILLOW CONFIGURATION

[76] Inventor: John A. Varaney, 20 Overton Ave., Milford, Conn. 06497

[21] Appl. No.: 874,369

[22] Filed: Feb. 1, 1978

[51] Int. Cl.[2] ..... A47C 23/06

[52] U.S. Cl. ..... 5/436; 5/437; 5/442; 5/494

[58] Field of Search ..... 5/93, 337–339, 5/340, 345, 352, 357, 329; 297/391

[56] References Cited

U.S. PATENT DOCUMENTS

| | | | |
|---|---|---|---|
| 2,577,595 | 12/1951 | Tobias | 5/337 |
| 3,137,870 | 6/1964 | Fink | 5/93 R |
| 3,327,330 | 6/1967 | McCullough | 5/337 |
| 3,667,074 | 6/1972 | Emery | 5/337 |
| 3,950,798 | 4/1976 | Borsini | 5/337 |
| 4,021,871 | 5/1977 | Wortman | 5/337 |
| 4,060,863 | 12/1977 | Craig | 5/337 |

*Primary Examiner*—Casmir A. Nunberg
*Attorney, Agent, or Firm*—Mattern, Ware, Davis & Stoltz

[57] ABSTRACT

By providing a pillow having a central head supporting portion with two extension portions, substantially perpendicular to the central portion, an extremely comfortable, restful, sleeper-encircling pillow incorporating built-in arm rests and blanket or sheet slip-prevention means is achieved. In the preferred embodiment, the pillow comprises a substantially uniform cross-sectional area throughout its entire length, with easily accessible, firm, supportive filler material disposed within an enclosing cover in order to allow the amount of filler material to be adjustable to one's particular needs.

9 Claims, 9 Drawing Figures

PILLOW CONFIGURATION

BACKGROUND OF THE INVENTION

This invention relates to pillows, and more particularly to an encircling pillow configuration.

Many varied pillow constructions, material compositions, and shapes are known in the prior art. However, all of these pillows, and particularly the conventional rectangular-shaped pillow, suffers from the major difficulty of being formed for manufacturing convenience and not for comfort and cooperation with an individual's anatomy or sleeping habits. As a result, conventional pillows comprise a generally rectangular shape, slightly tapered about its entire periphery, and incorporating maximum thickness in the center area.

This conventional construction is used throughout the country in its present state of evolvement, with developments and improvements generally directed to material-composition and arrangement, in order to provide maximum resilient support in the center area thereof. However, these improvements do not allow the user to comfortably employ the center area of the pillow without having to completely reshape or fold the entire pillow to suit his individual preferences. As a result, conventional pillows are generally fought with, manhandled, pounded, twisted, and turned throughout the entire night in order to provide a pillow configuration which will satisfy the individual's needs.

Generally, an individual employs only the lower half of a conventional pillow during an evening's sleep, which results in an overall waste of material, production time, and money. The direct result of typical sleeping habits and conventional pillows is a creation of a situation where an individual's head rests on the lower half of the pillow while the shoulder line of an individual is directly below the pillow body. Consequently, blankets or sheets which are used to cover the individual and retain his body heat are not in contact with the pillow structure and, as a result, are allowed to easily slip off the shoulders of the user, allowing various areas of his body to become exposed to the cooler room temperature. The obvious result of this chilling exposure is repeated awakening through the night, producing a restless and uncomfortable evening sleep.

Therefore, it is a principal object of this invention to provide a pillow configuration which is formed to interact comfortably with an individual's anatomy and sleeping habits.

Another object of this invention is to provide a pillow configuration incorporating the features described above which is inexpensive to manufacture and compatible with conventional pillow coverings.

Another object of this invention is to provide a pillow configuration incorporating the features described above which also is capable of interacting with blankets or sheets in order to maintain their position over the individual's shoulders throughout the evening.

Another object of this invention is to provide a pillow configuration incorporating the features described above wherein the entire pillow is employed and provides a restful, fight-free sleep.

Other and more specific objects will in part be obvious and will in part appear hereinafter.

SUMMARY OF THE INVENTION

The pillow configuration of the present invention eliminates all of the prior art difficulties by providing a pillow having a central head supporting portion forming the top of the pillow and two extension portions positioned substantially perpendicularly to the central portion, and extending substantially vertically downwardly therefrom. As a result, the area in juxtaposed spaced relationship to the head supporting zone of the central portion is substantially vacant, thereby providing an ideal area in which the shoulders, back or upper chest of the user can be comfortably located, directly in contact with the bed surface, providing a restful sleep, free of pillow fighting.

In one embodiment, the pillow of this invention incorporates an overall U-shape which peripherally surrounds or encircles the user's upper body with his head being positioned on the central portion of the pillow. As will be more fully described below, the pillow can also be substantially V-shaped for use by infants and small children.

By providing a pillow which incorporates a head supporting zone, which is substantially small in width then compared to conventional pillows, and has a normal thickness, the user is able to comfortably rest his head in the center of the head support zone of the central portion without placing his shoulders, back or upper chest on the pillow itself. In this way the head of the user is comfortably supported in a plane above the bed surface substantially equal to the particular distance between the user's shoulders and head, while the user's shoulders are in complete contact with the bed surface itself. As a result, the zone of the central portion of the pillow which has been specifically designed for maximizing head support can be totally employed without the discomfort of having one's shoulders on the pillow also, and having to tilt one's head sideways in order to rest one's head on the pillow.

Offset from the head supporting zone of the central portion of the pillow and extending substantially perpendicularly downwardly therefrom on both sides thereof are two extension portions. These portions extend below the shoulder line of the user in a position which provides extremely comfortable arm rests. As a result, the pillow of this invention eliminates flailing arms during sleep and blood circulation cutoff due to resting one's head on one's arm.

The extension portions also serve as a securement zone about which blankets and sheets can be mounted. Since these extension portions extend below the shoulder line of the user, blankets can be comfortably tucked about the extension portions and maintained in the desired shoulder height position throughout the night. Consequently, slipping blankets and cold, startling, evening chills are eliminated.

Furthermore, the extension portions can be of any desired length, so that any part of the body can be surrounded by the extension portions. In one embodiment, the extension portions are substantially the entire length of the bed. In this way, the user's entire body will be comfortably contained within the encircling pillow, maintaining the user warm and comfortable.

The invention accordingly comprises an article of manufacture possessing features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
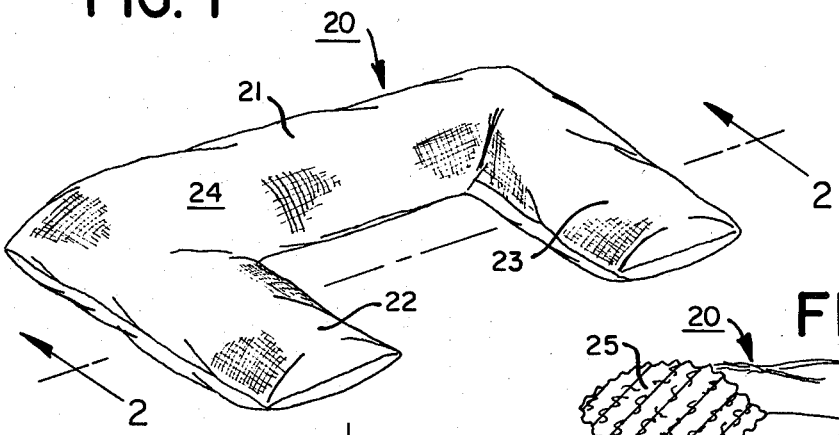
FIG. 1 is a perspective view of the pillow of this invention.

In FIG. 1, pillow 20 of the present invention is shown comprising central portion 21 and two extension portions 22 and 23, substantially perpendicular to central portion 21. Extension portions 22 and 23 are flexibly connected to central portion 21 in order to allow lateral movement of extension portions 22 and 23 to enhance the user's comfort, as will be more fully described below.

Figure 2:
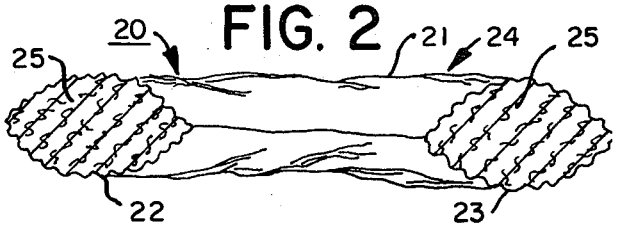
FIG. 2 is a front elevation view partially in cross-section taken along line 2—2 of FIG. 1.

Pillow 20 also incorporates a cover 24 which surrounds and forms the entire outer peripheral surface of pillow 20, and filler material 25 shown in FIG. 2, is contained within cover 24 and extends throughout the entire pillow area. Depending upon the particular requirements and use, filler 25 may comprise batt material, foam filler, or a combination of both.

In the preferred embodiment, filler 25 comprises batt material throughout the entire volume of cover 24 of pillow 20 in order to allow the specific supportive capability of pillow 20 to be controllable by the user. Since the quantity of batt material could be easily reduced or increased by the user, the particular concentration of batt material throughout pillow 20 is alterable by the user in order to provide the user with a particularly desired supportive quality.

In other embodiments, various combinations of batt material and foam material are employed as filler material 25 of pillow 20. In one such embodiment, central portion 21 comprises the batt material while the foam material is positioned in extension portions 22 and 23. In this way the comfortable, resilient supportive qualities inherent in the batt material is located in the head supportive zone of central portion 21, while the foam material is located in extension portions 22 and 23 where the user may comfortably rest his arms and securely support his sheets and blankets. Since batt material has been found to enhance heat retention, the use of foam material in the extension arms 22 and 23 is more desirable in areas where heat retention on cold nights is not required.

Figure 3:
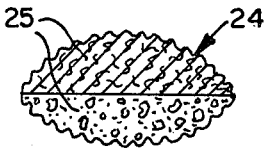
FIG. 3 is a partial cross-sectional front elevation view showing an alternative embodiment of the pillow of this invention.

In another embodiment, shown in FIG. 3, both batt material and foam material are contained within pillow 20 on opposite sides thereof. With this construction, the batt filled side of the pillow can be employed during cold weather in order to provide the heat retention capabilities inherent in the batt material, while the other side of the pillow can be employed during the warmer months when a cooler night's sleep without heat retention is desired. In this way, a multi-purpose pillow suitable to all climate conditions is provided.

Figure 4:
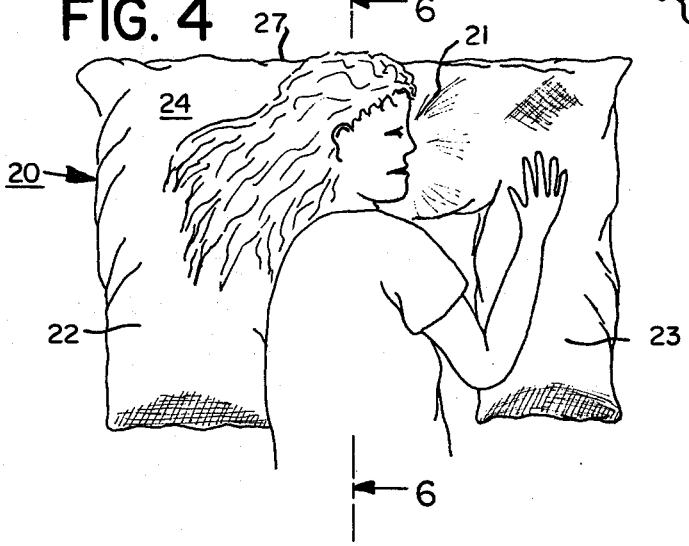
FIGS. 4 and 5 are top plan views showing the pillow of this invention in use.
Figure 6:
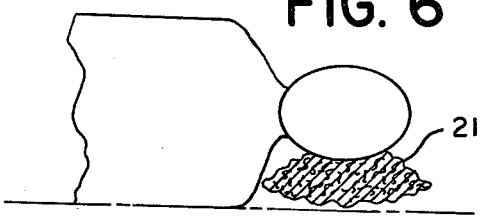
FIG. 6 is a side elevation view partially in cross-section taken along line 6—6 of FIG. 3.

The unique operation and cooperation of pillow 20 with the user can best be understood by referring to FIGS. 4 and 6. As shown in these Figures, central portion 21 of pillow 20 provides a head support zone for comfortably holding the head of the user, while extension portions 22 and 23 surround the upper torso of the user and provide readily accessible arm support areas. The use of pillow 20 allows the user to substantially "enter" the major portion of the pillow, providing a comfortable head support on central portion 21 while still allowing the shoulders or upper torso to be in contact with the bed surface. Furthermore, the encircling features, provided by extension portions 22 and 23, allows the user to comfortably move within encircling pillow 20 and have readily available and comfortably accessible support areas for his arms and shoulders.

Referring particularly to FIG. 6, one important feature of pillow 20 of this invention can best be understood. As shown therein, by employing pillow 20 of this invention an individual is capable of lying on his side while still having his head comfortably supported in a plane above the bed surface substantially equal to the distance between the bed surface and his head in its normal position perpendicular to the body. In this way, an individual employing pillow 20 of the present invention is not forced to tilt his head or pound, squeeze, twist, turn or otherwise mangle his pillow into a shape which will conform to his normal anatomy. Furthermore, the use of pillow 20 allows an individual to sleep in any position desired without being forced into specific positions where the pillow will provide some degree of restful support.

It has been found that by employing pillow 20 of the present invention a more restful night's sleep is achieved and tossing and turning is substantially reduced while pillow pounding and manipulation is virtually eliminated. Also, it has been found that the filler material does not shift position within the pillow, thereby eliminating areas in which the supportive characteristics are altered.

Figure 5:
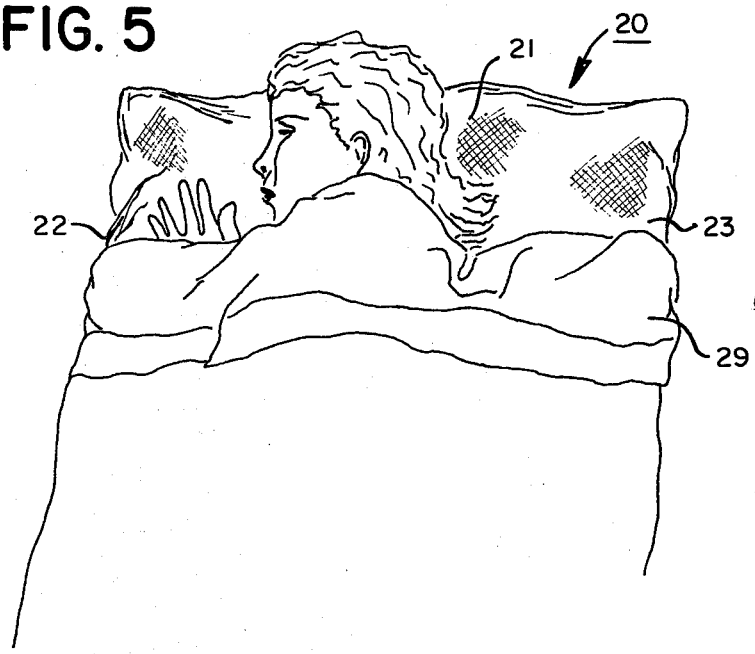

Another feature of pillow 20 of this invention is the use of extension portions 22 and 23 as retaining members for covering sheets and blankets. As shown in FIG. 5, blankets or sheets 29 can be secured about extension portions 22 and 23 in order to securely retain blankets or sheets 29 in position over the upper torso of the user. Since the use of pillow 20 of the present invention substantially eliminates repeated pillow movement and manipulation throughout one's sleep, pillow 20 remains substantially in a constant position, allowing sheets and blankets 29 to be securely retained about extension portions 22 and 23. This arrangement adds to the comfort of the individual throughout the evening while also assuring the user with a complete evening's sleep without fear of undesirable chilling exposure to the cooler air temperature of the room.

Figure 7:
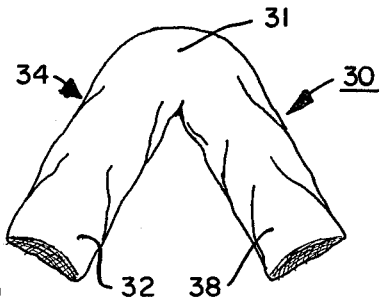
FIG. 7 is a top plan view of another embodiment of the pillow of this invention.

In FIG. 7, another embodiment of the pillow of this invention is shown. In this embodiment, pillow 30 comprises a central portion 31, and two extension portions 32 and 33 extending from central portion 31. Extension portions 32 and 33 are flexibly interconnected with central portion 31 in order to allow their movement, as may be desired. Also, pillow 30 incorporates a cover 34 which peripherally surrounds and establishes the outer peripheral surface of pillow 30.

In this embodiment, central portion 31 comprises an overall length less than the length of extension portions 32 and 33. As a result, pillow 30 comprises an overall V-shape as opposed to the overall U-shape of pillow 20, thoroughly described above. It has been found that pillow 30 is particularly useful for small children and infants in order to provide these small children with the benefits inherent in the pillow of this invention, while still having a pillow which is designed for their particular size. All of the features described above with reference to pillow 20 may be incorporated in the construction of pillow 30 in order to provide all of those inherent features in pillow 30 constructed for children.

Figure 8:
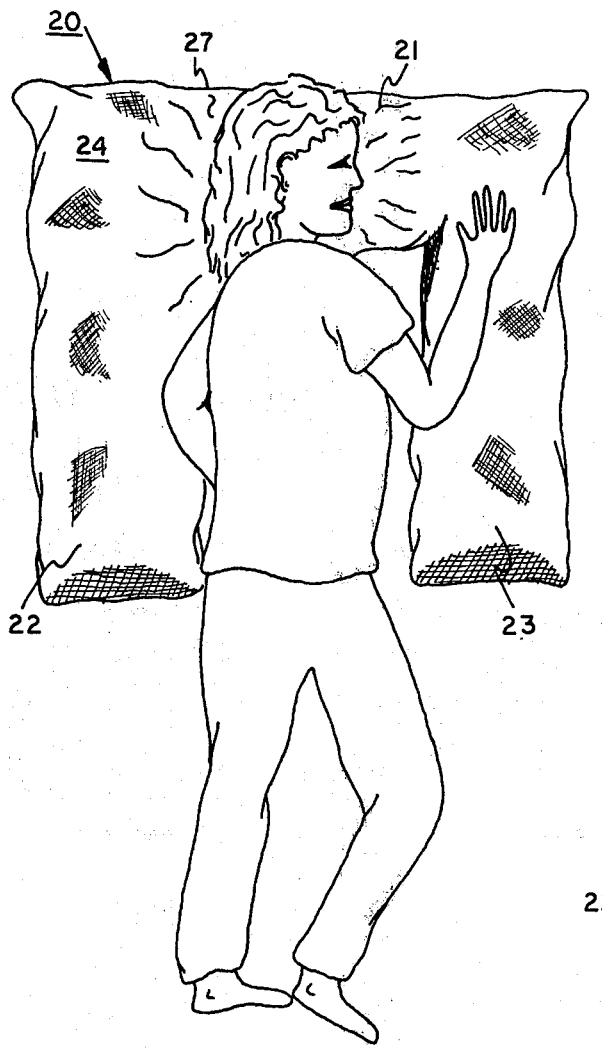
FIGS. 8 and 9 are top plan views of alternative embodiments of the pillow of this invention.
Figure 9:
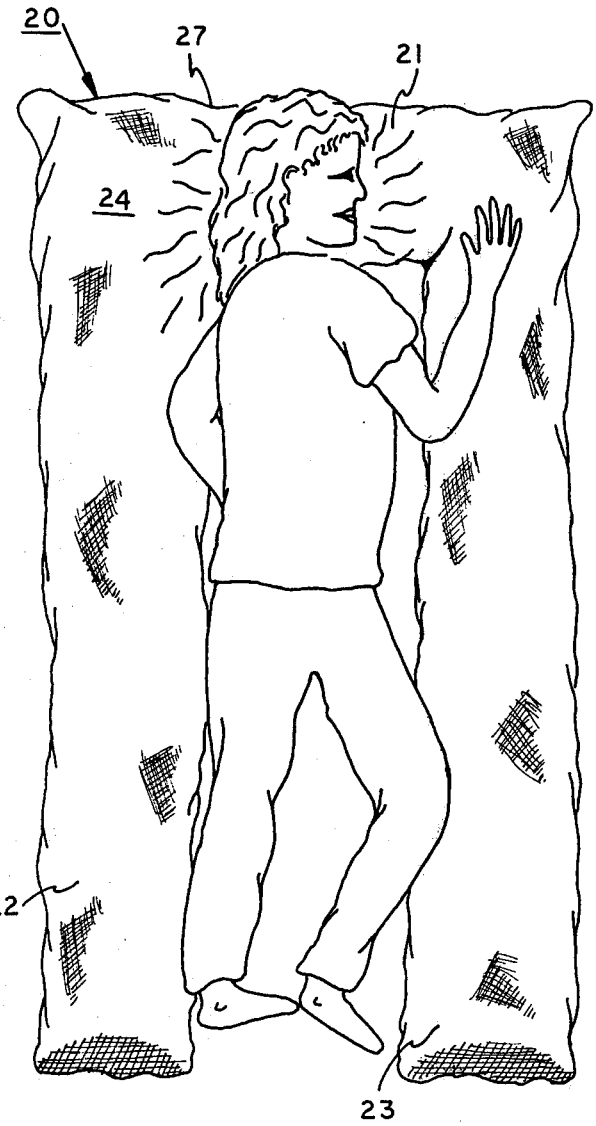

In FIGS. 8 and 9, additional embodiments of pillow 20 of the present invention is shown. In these embodiments, pillow 20 incorporates central portion 21 with extension portions 22 and 23 having greater lengths. In FIG. 8, extension portions 22 and 23 are shown with their terminating edges substantially co-extensive with the waist line of the user. In this way, substantially the entire upper torso of the user is encircled by pillow 20 for additional added comfort and blanket securement. Furthermore, additional body heat is retained, thereby providing added comfort during cold nights.

In FIG. 9, pillow 20 is shown with extension portions 22 and 23 extending substantially the entire length of the bed, thereby substantially completely encircling the user from head to toe. This full length pillow has been found to be extremely comfortable, providing added warmth throughout cold evenings.

Furthermore, this pillow construction is employable with yound children who have a tendency to roll out of bed during the evening. The full length embodiment shown in FIG. 9 provides additional edge restraint on both sides of the bed, thereby reducing the likelihood of a child rolling out of bed. Furthermore, the pillow provides complete blanket support and holding capabilities, further retaining the child in the warm, secure encircling pillow 20 of the present invention.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

it is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A pillow for comfortably encircling substantially the entire body of the user comprising:

A. a central portion for supporting the head of the user, and

B. two extension portions flexibly interconnected with said central portion, substantially perpendicular thereto, and extending substantially the entire length of the bed, providing arm rest zones and blanket retaining means, whereby the pillow comfortably supports the user's head, allowing him to enter a major portion of the pillow and merge comfortably therewith with the pillow sides encircling the user's body.

2. A pillow for comfortably encircling substantially the entire body of the user comprising:

A. a cover defining the outer peripheral surface of said pillow, said cover incorporating (a) a central portion, and (b) two extension portions substantially perpendicular to the central portion and each extending substantially the entire length of the bed; and B. filler material contained within said cover providing the desired amount of resilient support, whereby the pillow encircles substantially the entire body of the user while comfortably supporting the head of the user and allowing the user to enter a major portion of the pillow and merge comfortably therewith.

3. The pillow defined in claim 2, wherein said filler material comprises, one selected from the group consisting of batt material and foam material.

4. The pillow defined in claim 2, wherein said cover further comprises a readily accessible portal zone and said filler material comprises batt material disposed throughout the interior volume of the cover, whereby the quantity of batt material can be easily varied by the user.

5. A pillow as defined in claim 2, wherein said pillow comprises an overall U-shape.

6. A pillow defined in claim 2, wherein said pillow comprises an overall V-shape.

7. The pillow defined in claim 2, wherein said central portion incorporates a head supporting zone and said extension portions extend from the central portion below the shoulder line of the user, thereby providing both arm resting zones and sheet and blanket retaining means.

8. The pillow defined in claim 1, wherein the filler material of said extension portions comprises foam material.

9. The pillow defined in claim 1, wherein said pillow is further defined as comprising batt filler material disposed throughout said pillow central portion and extension portions on one side of the pillow and foam filler material is disposed throughout the central portion and extension portions of the other side of the pillow and in contact with the batt material, thereby providing a pillow having the capability of being used under all climate conditions.

* * * * *

UNITED STATES PATENT AND TRADEMARK OFFICE

CERTIFICATE OF CORRECTION

PATENT NO. : 4,173,048

DATED : November 6, 1979

INVENTOR(S) : John A. Varaney

It is certified that error appears in the above-identified patent and that said Letters Patent are hereby corrected as shown below:

Column 2, line 22 please delete "then" and substitute therefor --when--.

Column 5, line 36, please delete "yound" and substitute therefor --young--.

Column 5, line 53, please delete "it" and substitute therefor --It--.

Column 6, line 47, please delete "1" and substitute therefor --2--.

Column 6, line 50, please delete "1" and substitute therefor --2--.

Signed and Sealed this

*Twenty-seventh* Day of *May 1980*

[SEAL]

*Attest:*

SIDNEY A. DIAMOND

*Attesting Officer*

*Commissioner of Patents and Trademarks*